US009318255B2

(12) United States Patent
Masaki et al.

(10) Patent No.: US 9,318,255 B2
(45) Date of Patent: Apr. 19, 2016

(54) COIL COMPONENT

(71) Applicant: MURATA MANUFACTURING CO., LTD., Nagaokakyo-Shi, Kyoto-fu (JP)

(72) Inventors: Hiroyuki Masaki, Nagaokakyo (JP); Nobuyuki Kinami, Nagaokakyo (JP); Hiroshi Marusawa, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 14/488,789

(22) Filed: Sep. 17, 2014

(65) Prior Publication Data

US 2015/0002252 A1 Jan. 1, 2015

Related U.S. Application Data

(63) Continuation of application No. PCT/JP2013/056953, filed on Mar. 13, 2013.

(30) Foreign Application Priority Data

Mar. 29, 2012 (JP) ..... 2012-076688

(51) Int. Cl.

| | |
|---|---|
| ***H01F 27/24*** | (2006.01) |
| ***H01F 17/04*** | (2006.01) |
| ***H01F 27/28*** | (2006.01) |
| ***H01F 27/32*** | (2006.01) |
| ***H01F 27/29*** | (2006.01) |
| ***H01F 27/255*** | (2006.01) |
| *H01F 3/10* | (2006.01) |

(52) U.S. Cl.

CPC ..... *H01F 27/2876* (2013.01); *H01F 17/045* (2013.01); *H01F 27/255* (2013.01); *H01F 27/29* (2013.01); *H01F 27/327* (2013.01); *H01F 2003/106* (2013.01)

(58) Field of Classification Search

CPC ... H01F 27/2876; H01F 27/29; H01F 27/327; H01F 27/255; H01F 17/045; H01F 2003/106

USPC ..... 336/192, 221, 233, 83

See application file for complete search history.

(56) References Cited

U.S. PATENT DOCUMENTS 7,129,322 B2 10/2006 Toyoshima et al.
2005/0167639 A1* 8/2005 Hoshio et al. ..... 252/512

(Continued)

FOREIGN PATENT DOCUMENTS

CN 1331921 C 8/2007
JP 5-159958 6/1993

(Continued)

OTHER PUBLICATIONS

PCT/JP2013/056953 Written Opinion dated Jun. 11, 2013.

*Primary Examiner* — Mangtin Lian
(74) *Attorney, Agent, or Firm* — Arent Fox LLP

(57) ABSTRACT

A coil component that includes a drum-shaped core with an upper flange and a lower flange, a winding wound around the core, and an exterior resin between the upper flange and lower flange of the core. The exterior resin includes an inorganic filler at 91 to 95 mass % with respect to the exterior resin, and a resin that has more than one glass transition temperature and has a phase-separated structure. A flange spacing distance between the upper flange and the lower flange is 1.0 mm or less.

16 Claims, 1 Drawing Sheet

(56) References Cited

U.S. PATENT DOCUMENTS

| | | | | |
|---|---|---|---|---|
| 2007/0193022 | A1 | 8/2007 | Kuroiwa et al. | |
| 2008/0252406 | A1 * | 10/2008 | Kitajima et al. | 336/83 |

FOREIGN PATENT DOCUMENTS

| | | | |
|---|---|---|---|
| JP | 09-067426 | | 3/1997 |
| JP | 2005-210055 | A | 8/2005 |
| JP | 2010-016217 | A | 1/2010 |
| JP | 2010-098182 | A | 4/2010 |
| JP | 2010-098182 | A * | 4/2010 |
| JP | 2010-270197 | A | 12/2010 |
| JP | 2011-159793 | A | 8/2011 |

* cited by examiner

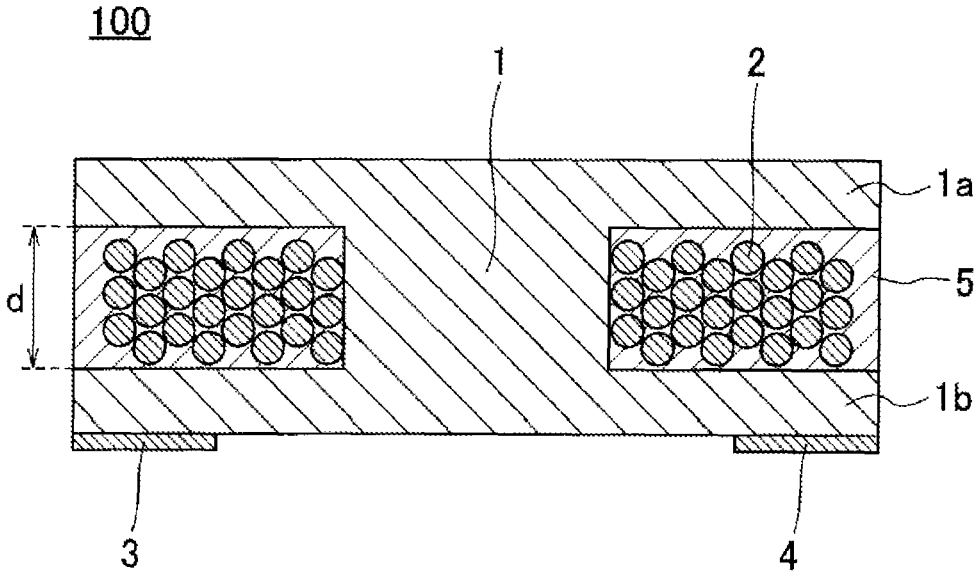
100
1
2
1a
5
1b
d
3
4

COIL COMPONENT

CROSS REFERENCE TO RELATED APPLICATIONS

The present application is a continuation of International application No. PCT/JP2013/056953, filed Mar. 13, 2013, which claims priority to Japanese Patent Application No. 2012-076688, filed Mar. 29, 2012, the entire contents of each of which are incorporated herein by reference.

FIELD OF THE INVENTION

The present invention relates to a coil component for use in various types of electronic devices, and more particularly, to a coil component including a drum-shaped core, a winding wound around the core, and an exterior resin formed between an upper flange and a lower flange of the core.

BACKGROUND OF THE INVENTION

Coil components including a drum-shaped core, a winding wound around the core, and an exterior resin formed between an upper flange and a lower flange of the core have been known as coil components for use in electronic devices. For example, Japanese Patent Application Laid-Open No. 2010-16217 (Patent Document 1) discloses a coil component in which the space between an upper flange and a lower flange is filled with an exterior resin including a thermosetting resin and an inorganic filler. The coil component is characterized in that the proportion of the inorganic filler to the exterior resin is 70 to 90 mass %. In addition, the coil component is characterized in that the inorganic filler includes a spherical filler, and the proportion of the spherical filler to the exterior resin is 20 mass % or more. The spherical filler included in the inorganic filler in the proportion mentioned above retains the fluidity of the exterior resin during filling, thus improving the productivity of the coil component. In addition, the exterior resin including the inorganic filler in the proportion mentioned above can bring the linear expansion coefficient of the exterior resin closer to that of the core, thereby increasing the heat cycle resistance of the coil component.

However, the heat cycle test described in Patent Document 1 is intended for a temperature range of −40° C. to 85° C., and in a wider temperature range, for example, a temperature range of −40° C. to 125° C., the exterior resin region is cracked by a thermal expansion of the exterior resin as long as the amount of filling in the Document is adopted. More specifically, as the temperature range is wider, the influence of the difference in linear expansion coefficient between the core and the exterior resin is increased to increase the stress generated when the exterior resin is cured or when the coil component is used, and make the exterior resin likely to be cracked.

Patent Document 1: Japanese Patent Application Laid-Open No. 2010-16217

SUMMARY OF THE INVENTION

Therefore, a main object of the present invention is to provide a coil component which has extremely excellent heat-resistance reliability.

The coil component according to the present invention is a coil component including: a drum-shaped core with an upper flange and a lower flange; a winding wound around the core; and an exterior resin formed between the upper flange and lower flange of the core, and the coil component is characterized in that the exterior resin includes: an inorganic filler at 91 to 95 mass % with respect to the exterior resin; and a resin that has more than one glass transition temperature and has a phase-separated structure, and flange spacing that is the distance between the upper flange and the lower flange is 1.0 mm or less.

The coil component according to the present invention can lower the linear expansion coefficient of the exterior resin because of the high filling percentage of the inorganic filler in the exterior resin, and thus keep the exterior resin from being cracked by thermal expansion and contraction during a heat cycle. Furthermore, the resin included in the exterior resin has more than one glass transition temperature, and has a phase-separated structure, thereby making it possible to set one or more of the glass transition temperatures in a temperature range of −40 to 125° C. In excess of the glass transition temperature, the phase with the glass transition temperature turns into a rubber state with a low elastic modulus, which absorbs stress generated in the exterior resin by thermal expansion. Therefore, crack generation can be suppressed which is caused by embrittlement of the exterior resin highly filled with the inorganic filler. As just described, it becomes possible to suppress the generation of cracks caused by the difference in linear expansion coefficient between the core and the exterior resin, and cracks caused by embrittlement of the exterior resin, and the generation of cracks in the exterior resin due to a heat cycle from −40 to 125° C. can be suppressed.

The coil component is preferably characterized in that the inorganic filler has one or more types of fillers, and one of the inorganic fillers is a spherical silica powder or a Ni—Zn ferrite powder.

The coil component is preferably characterized in that the exterior resin contains a ferrite powder, and the proportion of the ferrite powder to the exterior resin is 50 to 91 mass %.

The coil component is preferably characterized in that the exterior resin has loss tangent (tan δ) of 0.06 to 0.1, which is the ratio of a loss elastic modulus to a storage elastic modulus at 100° C. The loss tangent at 100° C., which is adjusted to 0.06 to 0.1 as just described, can suppress even core cracking in addition to exterior resin cracking due to a heat cycle.

The coil component is preferably characterized in that the storage elastic modulus of the exterior resin at 125° C. is 7.6 GPa or less. By adjusting the storage elastic modulus of the exterior resin at 125° C. to 7.6 GPa or less as just described, the exterior resin can absorb stress generated between the core and the exterior resin due to warpage of a mounting substrate, which is caused during a heat cycle. This can suppress even core cracking in addition to exterior resin cracking.

The coil component is preferably characterized in that the resin included in the exterior resin includes an epoxy resin and a phenoxy resin, and the proportion of the phenoxy resin to the total of the epoxy resin and the phenoxy resin is 40 to 60 mass %. The resin included in the exterior resin includes the epoxy resin and the phenoxy resin, and the resin can thereby have more than one glass transition temperature, and have a phase-separated structure. The phenoxy resin included in the resin can form a phase that has a glass transition temperature in a temperature range of −40 to 125° C. In addition, the proportion of the phenoxy resin with a high linear expansion coefficient, which is limited as mentioned above, allows the loss tangent of the exterior resin at 100° C. to fall within the range of 0.06 to 0.1, thereby suppressing stress generated in the exterior resin by expansion and contraction during a heat cycle.

The coil component is preferably characterized in that the resin includes an epoxy resin and a phenoxy resin, and the proportion of the phenoxy resin to the exterior resin is 1 to 2 mass %. The proportion of the phenoxy resin to the exterior resin, which is limited as just described, can ensure that the storage elastic modulus of the exterior resin is reduced to 7.6 GPa or less.

The coil component is preferably characterized in that the epoxy resin is a cresol novolac-type epoxy resin.

In the coil component, the drum-shaped core which can be put into practical use as a coil component with an exterior resin preferably has flange spacing of 0.3 mm or more.

The coil component is preferably characterized in that the exterior resin includes: a main agent containing the resin, but containing no curing accelerator; and an accessory agent containing no resin, but containing the curing accelerator, and the exterior resin has the main agent and accessory agent mixed immediately before being applied to the core, applied to the core, and subjected to curing. This mixing can suppress influences on workability, component characteristics, etc, without going through gradual curing by the dissolution of the curing accelerator, or increasing the viscosity of the coating agent.

The coil component according to the present invention makes it possible to suppress the generation of cracks caused by the difference in linear expansion coefficient between the core and the exterior resin, and cracks caused by embrittlement of the exterior resin, thereby suppressing the generation of cracks in the exterior resin due to a heat cycle from −40 to 125° C. More specifically, it becomes possible to provide a coil component which has extremely excellent heat-resistance reliability.

The above-mentioned object, other objects, features, and advantages of this invention will be further evident from the following description with reference to the drawings.

BRIEF EXPLANATION OF THE DRAWING

The FIGURE shows a cross-sectional view of an embodiment of a coil component according to the present invention.

DETAILED DESCRIPTION OF THE INVENTION

An embodiment of a coil component according to the present invention will be described below with reference to the FIGURE.

The coil component 100 shown in the FIGURE includes a drum-shaped core 1 with an upper flange 1*a* and a lower flange 1*b*, a winding 2 wound around the core 1, and an exterior resin 5 formed between the upper flange 1*a* and the lower flange 1*b*. The distance d between two dashed lines as shown in the FIGURE indicates flange spacing that is the distance between the upper flange 1*a* and lower flange 1*b* of the drum-shaped core 1.

The drum-shaped core 1 is formed from a magnetic body, and the flange spacing d is 0.3 to 1.0 mm for the reason mentioned later.

The winding 2 is preferably a copper wire which is excellent in electrical conductivity.

External electrodes 3, 4 are formed on the surface of the lower flange 1*b* of the core 1, and the external electrodes 3, 4 are electrically connected to the winding 2 by soldering or thermocompression bonding, or the like. The coil component 100 is electrically connected through the external electrodes 3, 4 to a mounting substrate or the like.

The exterior resin 5 including an inorganic filler and a resin is formed between the upper flange 1*a* and the lower flange 1*b* in order to improve the strength of the coil component 100.

The coil component 100 can be obtained by winding the winding 2 between the upper flange 1*a* and lower flange 1*b* of the drum-shaped core 1, then injecting the exterior resin 5 including the inorganic filler and the resin between the upper flange 1*a* and the lower flange 1*b* so as to cover the winding 2, and curing the exterior resin 5.

The flange spacing d which is the distance between the upper flange 1*a* and lower flange 1*b* of the drum-shaped core 1 is characteristically 0.3 to 1.0 mm. The flange spacing more than 1.0 mm increases the amount of the resin applied, and increases the stress when the resin is cured, and the exterior resin thus comes to fail to withstand the stress. Therefore, the flange spacing d is limited to 1.0 mm or less. On the other hand, in a coil component using a drum-shaped core with narrow flange spacing such as flange spacing of 1.0 mm or less, the inorganic filler contained in the exterior resin has to be reduced in particle size, embrittlement of, in particular, the exterior resin is thus likely to be caused, and there is accordingly a problem that the exterior resin is likely to be cracked during a heat cycle. According to the present invention, the problem mentioned above can be resolved, because the coil component can be provided which has the flange spacing of 1.0 mm or less, and suppresses cracking of the exterior resin during a heat cycle as described later. Therefore, the coil component according to the present invention is used in a preferred manner device, etc. which require a low-profile coil component. It is to be noted that the flange spacing d is limited to 0.3 mm or more, because drum-shaped cores which can be put into practical use as coil components with an exterior resin have flange spacing of 0.3 mm or more.

Subsequently, the exterior resin 5 will be described in more detail.

The exterior resin 5 is characterized by including an inorganic filler at 91 to 95 mass % with respect to the exterior resin 5. The exterior resin highly filled with the inorganic filler is able to lower the linear expansion coefficient of the exterior resin. The lowered linear expansion coefficient of the exterior resin leads to a reduced difference in linear expansion coefficient between the core 1 and the exterior resin 5. Therefore, the generation of cracks during a heat cycle can be suppressed, which is caused by the difference in linear expansion coefficient between the core 1 and the exterior resin 5.

The inorganic filler included in the exterior resin 5 preferably contains a ferrite powder, in order to increase the inductance of the coil by formation of a magnetic flux path. The type of the ferrite powder is not particularly limited, but examples of the ferrite powder include, for example, Ni—Zn ferrite and Mn—Zn ferrite. In addition, the inorganic filler can include a spherical filler in order to retain the fluidity of the exterior resin during filling, thereby improving the productivity of the coil component. The type of the spherical filler is not particularly limited, but examples of the spherical filler include, for example, spherical silica and spherical alumina.

As described above, the increased filling percentage of the inorganic filler can suppress cracking during a heat cycle, which is caused by the difference in linear expansion coefficient between the core 1 and the exterior resin 5. On the other hand, however, the resin highly filled with the inorganic filler leads to embrittlement of the exterior resin, which causes cracking during a heat cycle.

Therefore, the exterior resin is further characterized by including a resin that has more than one glass transition temperature, and has a phase-separated structure. The resin has more than one glass transition temperature, and has a phase-separated structure, thereby making it possible to suppress the generation of cracks during a heat cycle, which is caused by the embrittlement of the exterior resin as described above. The reason will be described below.

In this regard, a resin that has two different glass transition temperatures $Tg_1$ and $Tg_2$ ($Tg_1<Tg_2$) and has a two-phase separated structure will be considered as an example. It is known that regarding a substance that has a glass transition temperature, typically, an amorphous state of the substance at temperatures below the glass transition temperature is referred to as a glass state, whereas a state thereof at temperatures above the glass transition temperature and below the melting point is referred to as a rubber state, and the elastic modulus of the rubber state is extremely low as compared with the elastic modulus of the glass state. In the case of the resin which has a two-phase separated structure, the two separated phases of the resin both have a glass state in a temperature range below the lower glass transition temperature $Tg_1$ of the two different glass transition temperatures. When the resin is heated from this state to cause the temperature reach the temperature range above $Tg_1$ and below $Tg_2$, one of the two separated phases remains in a glass state, whereas the other turns into a rubber state because of the temperature in excess of the glass transition temperature $Tg_1$. As just described, due to the existence of the rubber-state phase with a low elastic modulus in the resin, the rubber phase absorbs stress generated in the resin by thermal expansion. This leads to improved strength and toughness of the exterior resin in a temperature range above the glass transition temperature $Tg_1$, thus as a result, making it possible to suppress the generation of cracks during a heat cycle due to embrittlement of the exterior resin.

The resin included in the exterior resin can be obtained by mixing multiple resins that respectively have different glass transition temperatures, in order to have more than one glass transition temperature. The resin included in the exterior resin is not particularly limited as long as the resin has more than one glass transition temperature, and has a phase separated structure, but preferably contains a curable resin in order to improve the strength of the coil component 100. For example, thermosetting resins such as epoxy resins can be used as the curable resin.

The resin included in the exterior resin preferably includes an epoxy resin, a phenoxy resin, and a curing agent, and includes a curing accelerator, if necessary. This resin is preferably characterized in that the proportion of the phenoxy resin to the total of the epoxy resin and the phenoxy resin is 40 to 60 mass %. Because the phenoxy resin has a glass transition temperature in a temperature range of −40 to 125° C., the resin included in the exterior resin has a rubber phase in a temperature range in excess of the glass transition temperature, and the rubber phase can absorb stress due to expansion and contraction. In addition, the increased proportion of the phenoxy resin with a high linear expansion coefficient will increase stress due to thermal expansion. On the other hand, the decreased proportion of the phenoxy resin with a high linear expansion coefficient results in failure to sufficiently absorb the stress due to expansion and contraction, because of the decreased proportion of the rubber phase. For this reason, the loss tangent tan δ of the exterior resin at 100° C. is limited to 0.06 to 0.1 by adjusting the proportion of the phenoxy resin to the total of the epoxy resin and phenoxy resin to fall within the range of 40 to 60 mass %. This limitation on the loss tangent tan δ can suppress the generation of cracks in the exterior resin due to a heat cycle, and also suppress cracking of the core.

Furthermore, among epoxy resins, cresol novolac-type epoxy resins are preferred which have a high crosslink density and glass transition temperature, and have excellent heat resistance. The cresol novolac-type epoxy resins and phenoxy resins are respectively represented by the following structural formulas (1) and (2).

[Chemical Formula 1]

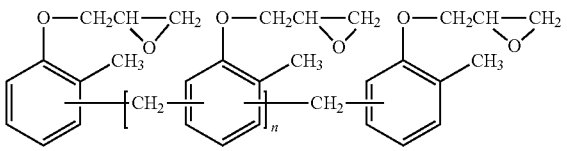

(1)

[Chemical Formula 2]

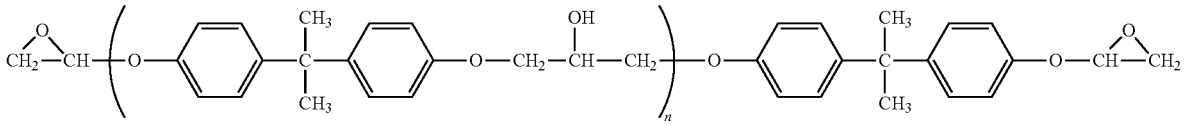

(2)

(10)

In addition, the excessively high filling percentage of the inorganic filler in the exterior resin results in embrittlement of the exterior resin to such an extent that the above-described phase-separated structure of the exterior resin fails to suppress cracking during a heat cycle, and the proportion of the inorganic filler to the exterior resin is thus limited to 95 mass % or less.

In the coil component described above, the storage elastic modulus of the exterior resin at 125° C. is preferably 7.6 GPa or less. By adjusting the storage elastic modulus of the exterior resin at 125° C. to 7.6 GPa or less as just described, the exterior resin can absorb stress generated between the core and the exterior resin due to warpage of the mounting substrate, which is caused during a heat cycle. This can suppress even core cracking in addition to exterior resin cracking.

The coil component is preferably characterized in that the resin includes an epoxy resin and a phenoxy resin, and the proportion of the phenoxy resin to the exterior resin is 1 to 2 mass %. The proportion of the phenoxy resin to the exterior resin, which is limited as just described, can ensure that the storage elastic modulus of the exterior resin is reduced to 7.6 GPa or less.

EXPERIMENTAL EXAMPLE

The coil component according to the present invention was evaluated in terms of heat-resistance reliability.

Coil components according to the present invention were obtained in accordance with Examples 1 to 11 described below. In addition, coil components for comparison with the coil components according to the present invention were obtained in accordance with Comparative Examples 1 to 7.

Example 1

Mixed were: 662.7 g of ferrite (D50=0.6 μm) and 139.5 g of spherical silica (D50=8 μm) as an inorganic filler; 17.8 g of cresol novolac-type epoxy resin (epoxy equivalent 218) as an epoxy resin; 8.7 g of phenolic resin as a curing agent; 6.5 g of phenoxy resin (MW=50,000); 155.1 g of dipropylene methyl ether acetate as a solvent; 0.3 g of an imidazole-based curing accelerator; 6.4 g of a dispersant; and 3.0 g of a coupling agent, for obtaining an exterior resin. The same solvent was added to the obtained exterior resin to attenuate the viscosity to approximately 1 Pa·s, and the resin was applied to a copper wire-wound drum-shaped ferrite core with flange spacing of 0.85 mm with the use of a dispenser (inside nozzle diameter: 250 μm), and subjected to drying at 80° C., and curing at 150° C. to obtain a coil component. Through the compounding as described above, the proportions of the inorganic filler and phenoxy resin to the exterior resin are respectively 95 mass % and 0.8 mass %, and the mass ratio between the epoxy resin and the phenoxy resin is epoxy resin:phenoxy resin=73:27.

Example 2

Except for the application to a copper wire-wound drum-shaped ferrite core with flange spacing of 0.32 mm, a coil component was obtained in the same way as in Example 1. Through the compounding as described above, the proportions of the inorganic filler and phenoxy resin to the exterior resin are respectively 95 mass % and 0.8 mass %, and the mass ratio between the epoxy resin and the phenoxy resin is epoxy resin:phenoxy resin=73:27.

Example 3

Mixed were: 675.6 g of ferrite (D50=0.6 μm) and 94.8 g of spherical silica (D50=8.0 μm) as an inorganic filler; 35.3 g of cresol novolac-type epoxy resin (epoxy equivalent 218) as an epoxy resin; 17.0 g of phenolic resin as a curing agent; 7.0 g of phenoxy resin (MW=50,000); 149.0 g of dipropylene methyl ether acetate as a solvent; 0.6 g of an imidazole-based curing accelerator; 5.7 g of a dispersant; and 5.2 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 92 mass % and 0.8 mass %, and the mass ratio between the epoxy resin and the phenoxy resin is epoxy resin:phenoxy resin=83:17.

Example 4

Mixed were: 661.2 g of ferrite (D50=0.6 μm) and 139.2 g of spherical silica (D50=8.0 μm) as an inorganic filler; 19.3 g of cresol novolac-type epoxy resin (epoxy equivalent 218) as an epoxy resin; 9.4 g of phenolic resin as a curing agent; 6.4 g of phenoxy resin (MW=50,000); 157.1 g of dipropylene methyl ether acetate as a solvent; 0.3 g of an imidazole-based curing accelerator; 6.3 g of a dispersant; and 3.1 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 0.8 mass %, and the mass ratio between the epoxy resin and the phenoxy resin is epoxy resin:phenoxy resin=75:25.

Example 5

Mixed were: 662.7 g of ferrite (D50=0.6 μm) and 139.5 g of spherical silica (D50=8.0 μm) as an inorganic filler; 13.4 g of cresol novolac-type epoxy resin (epoxy equivalent 218) as an epoxy resin; 6.6 g of phenolic resin as a curing agent; 13.0 g of phenoxy resin (MW=50,000); 155.1 g of dipropylene methyl ether acetate as a solvent; 0.3 g of an imidazole-based curing accelerator; 6.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 1.5 mass %, and the mass ratio between the epoxy resin and the phenoxy resin is epoxy resin:phenoxy resin=51:49.

Example 6

Except for the application to a copper wire-wound drum-shaped ferrite core with flange spacing of 0.32 mm, a coil component was obtained and evaluated in the same way as in Example 5. Through the compounding as described above, the proportions of the inorganic filler and phenoxy resin to the exterior resin are respectively 95 mass % and 1.5 mass %, and the mass ratio between the epoxy resin and the phenoxy resin is epoxy resin:phenoxy resin=51:49.

Example 7

Mixed were: 664.8 g of ferrite (D50=0.6 μm) and 140.0 g of spherical silica (D50=8.0 μm) as an inorganic filler; 11.2 g of cresol novolac-type epoxy resin (epoxy equivalent 218) as an epoxy resin; 5.4 g of phenolic resin as a curing agent; 16.3 g of phenoxy resin (MW=50,000); 129.4 g of dipropylene methyl ether acetate as a solvent; 0.3 g of an imidazole-based curing accelerator; 6.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 1.9 mass %, and the mass ratio between the epoxy resin and the phenoxy resin is epoxy resin:phenoxy resin=41:59.

Example 8

Mixed were: 776.9 g of ferrite (D50=0.6 μm) as an inorganic filler; 30.0 g of cresol novolac-type epoxy resin (epoxy equivalent 218) as an epoxy resin; 16.1 g of phenolic resin as a curing agent; 16.5 g of phenoxy resin (MW=50,000); 145.4 g of dipropylene methyl ether acetate as a solvent; 0.8 g of an imidazole-based curing accelerator; 4.7 g of a dispersant; and 5.5 g of a coupling agent, for obtaining an exterior resin. The obtained exterior resin was used to obtain and evaluate a coil component in the same way as in Example 1. Through the compounding as described above, the proportions of the inorganic filler and phenoxy resin to the exterior resin are respectively 91 mass % and 1.9 mass %, and the mass ratio between the epoxy resin and the phenoxy resin is epoxy resin:phenoxy resin=65:35.

Example 9

Mixed were: 398.0 g of ferrite (D50=0.6 μm) and 351.5 g of spherical silica (D50=8.0 μm) as an inorganic filler; 16.8 g of cresol novolac-type epoxy resin (epoxy equivalent 218) as an epoxy resin; 8.3 g of phenolic resin as a curing agent; 16.4 g of phenoxy resin (MW=50,000); 149.3 g of dipropylene methyl ether acetate as a solvent; 0.4 g of an imidazole-based curing accelerator; 8.4 g of a dispersant; and 3.7 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 93 mass % and 2.0 mass %, and the mass ratio between the epoxy resin and the phenoxy resin is epoxy resin:phenoxy resin=51:49.

Example 10

Mixed were: 513.4 g of ferrite (D50=0.6 μm) and 288.8 g of spherical silica (D50=8.0 μm) as an inorganic filler; 15.8 g of cresol novolac-type epoxy resin (epoxy equivalent 218) as an epoxy resin; 7.8 g of phenolic resin as a curing agent; 10.6 g of phenoxy resin (MW=50,000); 155.1 g of dipropylene methyl ether acetate as a solvent; 0.3 g of an imidazole-based curing accelerator; 6.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 1.2 mass %, and the mass ratio between the epoxy resin and the phenoxy resin is epoxy resin:phenoxy resin=60:40.

Example 11

Mixed were: 618.9 g of ferrite (D50=0.6 μm) and 120.3 g of spherical silica (D50=8.0 μm) as an inorganic filler; 12.1 g of cresol novolac-type epoxy resin (epoxy equivalent 218) as an epoxy resin; 6.0 g of phenolic resin as a curing agent; 14.3 g of phenoxy resin (MW=50,000); 155.1 g of dipropylene methyl ether acetate as a solvent; 0.3 g of an imidazole-based curing accelerator; 8.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 1.7 mass %, and the mass ratio between the epoxy resin and the phenoxy resin is epoxy resin:phenoxy resin=46:54.

Comparative Example 1

Except for the application to a copper wire-wound drum-shaped ferrite core with flange spacing of 2.0 mm, a coil component was obtained in the same way as in Example 1. As in the case of Example 1, the proportions of the inorganic filler and phenoxy resin to the exterior resin are respectively 95 mass % and 0.8 mass %, and the mass ratio between the epoxy resin and the phenoxy resin is epoxy resin:phenoxy resin=73:27.

Comparative Example 2

Except for the application to a copper wire-wound drum-shaped ferrite core with flange spacing of 2.0 mm, a coil component was obtained in the same way as in Example 5. As in the case of Example 5, the proportions of the inorganic filler and phenoxy resin to the exterior resin are respectively 95 mass % and 1.5 mass %, and the mass ratio between the epoxy resin and the phenoxy resin is epoxy resin:phenoxy resin=51:49.

Comparative Example 3

Mixed were: 662.7 g of ferrite (D50=0.6 μm) and 139.5 g of spherical silica (D50=8.0 μm) as an inorganic filler; 22.3 g of cresol novolac-type epoxy resin (epoxy equivalent 218) as an epoxy resin; 10.7 g of phenolic resin as a curing agent; 155.1 g of dipropylene methyl ether acetate as a solvent; 0.3 g of an imidazole-based curing accelerator; 6.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 0 mass %, and the mass ratio between the epoxy resin and the phenoxy resin is epoxy resin:phenoxy resin=100:0.

Comparative Example 4

Except for the application to a copper wire-wound drum-shaped ferrite core with flange spacing of 0.32 mm, a coil component was obtained in the same way as in Comparative Example 3. As in the case of Comparative Example 3, the proportions of the inorganic filler and phenoxy resin to the exterior resin are respectively 95 mass % and 0 mass %, and the mass ratio between the epoxy resin and the phenoxy resin is epoxy resin:phenoxy resin=100:0.

Comparative Example 5

Mixed were: 665.5 g of ferrite (D50=0.6 μm) and 140.1 g of spherical silica (D50=8.0 μm) as an inorganic filler; 8.9 g of cresol novolac-type epoxy resin (epoxy equivalent 218) as an epoxy resin; 4.3 g of phenolic resin as a curing agent; 19.6 g of phenoxy resin (MW=50,000); 123.6 g of dipropylene methyl ether acetate as a solvent; 0.3 g of an imidazole-based curing accelerator; 6.4 g of a dispersant; and 2.9 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 95 mass % and 2.3 mass %, and the mass ratio between the epoxy resin and the phenoxy resin is epoxy resin:phenoxy resin=31:69.

Comparative Example 6

Mixed were: 694.2 g of ferrite (D50=0.6 μm) and 29.2 g of spherical silica (D50=8.0 μm) as an inorganic filler; 61.7 g of cresol novolac-type epoxy resin (epoxy equivalent 218) as an epoxy resin; 29.7 g of phenolic resin as a curing agent; 6.8 g of phenoxy resin (MW=50,000); 154.0 g of dipropylene methyl ether acetate as a solvent; 1.0 g of an imidazole-based curing accelerator; 4.7 g of a dispersant; and 8.6 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 87 mass % and 0.8 mass %, and the mass ratio between the epoxy resin and the phenoxy resin is epoxy resin:phenoxy resin=90:10.

Comparative Example 7

Mixed were: 656.6 g of ferrite (D50=0.6 μm) and 161.3 g of spherical silica (D50=8.0 μm) as an inorganic filler; 8.8 g of cresol novolac-type epoxy resin (epoxy equivalent 218) as an epoxy resin; 4.2 g of phenolic resin as a curing agent; 6.9 g of phenoxy resin (MW=50,000); 144.7 g of dipropylene methyl ether acetate as a solvent; 0.2 g of an imidazole-based curing accelerator; 6.7 g of a dispersant; and 1.8 g of a coupling agent, for obtaining an exterior resin. The obtained exterior resin was used to obtain a coil component in the same way as in Example 1. Through the compounding as described above, the proportions of the inorganic filler and phenoxy resin to the exterior resin are respectively 97 mass % and 0.8 mass %, and the mass ratio between the epoxy resin and the phenoxy resin is epoxy resin:phenoxy resin=56:44.

It is to be noted that in the examples and comparative examples described above, the phenoxy resin is poorly soluble, and methyl ethyl ketone (hereinafter, referred to as MEK) is used for dissolving the phenoxy resin.

Next, the coil components obtained by the methods described above according to the respective examples and the respective comparative examples, and the exterior resins for use in the coil components were evaluated with respect to the following items.

1) Presence or Absence of Resin Cracking

The coil components according to the respective examples and respective comparative examples were solder-mounted onto a substrate (FR-4, 1.6 mm in thickness) with a metal mask thickness of 100 μm, subjected to a heat cycle test (−40° C. to 125° C., 2000 cycles), and whether the external resin sections of the coil components were cracked or not was observed with the use of an optical microscope.

2) Presence or Absence of Core Cracking

The coil components according to the respective examples and respective comparative examples were solder-mounted onto a substrate (FR-4, 1.6 mm in thickness) with a metal mask thickness of 100 μm, subjected to a heat cycle test (−40° C. to 125° C., 2000 cycles), and whether the cores of the coil components were cracked or not was observed with the use of an optical microscope.

3) Glass Transition Temperature (Tg)

The exterior resins used for the coil components according to the respective examples and the respective comparative examples were subjected to curing to prepare test pieces of 10 mm in width×50 mm in length×0.5 mm in thickness, and a viscoelastic spectrometer from Seiko Instruments Inc. was used to make dynamic viscoelastic measurements, and measure the glass transition temperatures from the peaks of tan δ.

4) Loss Tangent (Tan δ)

The exterior resins used for the coil components according to the respective examples and the respective comparative examples were subjected to curing to prepare test pieces of 10 mm in width×50 mm in length×0.5 mm in thickness, and a viscoelastic spectrometer from Seiko Instruments Inc. was used to make dynamic viscoelastic measurements, and measure the loss tangent (tan δ) as the ratio of the loss elastic modulus to the storage elastic modulus at 100° C.

5) Storage Elastic Modulus (E')

The exterior resins used for the coil components according to the respective examples and the respective comparative examples were subjected to curing to prepare test pieces of 10 mm in width×50 mm in length×0.5 mm in thickness, and a viscoelastic spectrometer from Seiko Instruments Inc. was used to make dynamic viscoelastic measurements, and measure the storage elastic modulus E' at 125° C.

Table 1 shows the results of evaluating Examples 1 to 11 and Comparative Examples 1 to 7 with respect to the items described above.

TABLE 1

| | Inorganic Filler (parts by weight) | Ferrite (parts by weight) | Epoxy Resin (parts by weight) | Phenoxy Resin (parts by weight) | Epoxy/ Phenoxy Mass Ratio | Dis-persant (parts by weight) | Coupling Agent (parts by weight) | Flange Spacing (mm) | Exterior Resin Crack-ing | Core Crack-ing | Tg (° C.) | 100° C. tanδ | 125° C. E' |
|---|---|---|---|---|---|---|---|---|---|---|---|---|---|
| Example 1 | 95 | 78 | 2.1 | 0.8 | 73:27 | 0.8 | 0.3 | 0.85 | No | Yes | 103, 179 | 0.05 | 8.7 |
| Example 2 | 95 | 78 | 2.1 | 0.8 | 73:27 | 0.8 | 0.3 | 0.32 | No | Yes | | | |
| Example 3 | 92 | 80 | 4.3 | 0.8 | 83:17 | 0.8 | 0.6 | 0.85 | No | Yes | 108, 176 | 0.05 | 8.8 |
| Example 4 | 95 | 78 | 2.3 | 0.8 | 75:25 | 0.7 | 0.4 | 0.85 | No | Yes | 105, 186 | 0.05 | 10.7 |
| Example 5 | 95 | 78 | 1.6 | 1.5 | 51:49 | 1.5 | 0.3 | 0.85 | No | No | 103, 180 | 0.08 | 7.6 |
| Example 6 | 95 | 78 | 1.6 | 1.5 | 51:49 | 1.5 | 0.3 | 0.32 | No | No | | | |
| Example 7 | 95 | 78 | 1.3 | 1.9 | 41:59 | 1.9 | 0.3 | 0.85 | No | No | 102, 182 | 0.10 | 6.3 |
| Example 8 | 91 | 91 | 3.5 | 1.9 | 65:35 | 0.6 | 0.6 | 0.85 | No | No | 105, 182 | 0.06 | 7.5 |
| Example 9 | 93 | 50 | 2.1 | 2.0 | 51:49 | 1.0 | 0.5 | 0.85 | No | No | 105, 180 | 0.06 | 6.0 |
| Example 10 | 95 | 61 | 1.9 | 1.2 | 60:40 | 0.8 | 0.3 | 0.85 | No | No | 101, 178 | 0.06 | 8.5 |
| Example 11 | 95 | 81 | 1.4 | 1.7 | 46:54 | 0.8 | 0.3 | 0.85 | No | No | 105, 179 | 0.10 | 6.8 |
| Comparative Example 1 | 95 | 78 | 2.1 | 0.8 | 73:27 | 0.8 | 0.3 | 2 | Yes | Yes | 103, 180 | 0.05 | 7.6 |
| Comparative Example 2 | 95 | 78 | 1.6 | 1.5 | 51:49 | 0.8 | 0.3 | 2 | Yes | Yes | 103, 179 | 0.08 | 8.7 |
| Comparative Example 3 | 95 | 78 | 2.7 | 0 | 100:0 | 0.8 | 0.3 | 0.85 | Yes | No | 186 | 0.04 | 11.0 |
| Comparative Example 4 | 95 | 78 | 2.7 | 0 | 100:0 | 0.8 | 0.3 | 0.32 | Yes | No | | | |
| Comparative Example 5 | 95 | 78 | 1.1 | 2.3 | 31:69 | 0.8 | 0.3 | 0.85 | Yes | No | 101 | 0.14 | 6.4 |
| Comparative Example 6 | 87 | 83 | 7.5 | 0.8 | 90:10 | 0.6 | 1 | 0.85 | Yes | Yes | 99, 186 | 0.04 | 8.3 |
| Comparative Example 7 | 97 | 78 | 1.1 | 0.8 | 56:44 | 0.8 | 0.2 | 0.85 | Yes | Yes | 99, 181 | 0.09 | 8.4 |

The coil components according to Examples 1 to 11 refer to a coil component in which the exterior resin contains the inorganic filler at 91 to 95 mass % with respect to the exterior resin, and the resin which has more than one glass transition temperature and has a phase-separated structure, and the flange spacing is 1.0 mm or less which refers to the distance between the upper flange and lower flange of the drum-shaped core of the coil component. Furthermore, the coil components according to the examples are characterized in that the resin contained in the exterior resin contains the epoxy resin and the phenoxy resin, and the proportion of the phenoxy resin to the total of the epoxy resin and phenoxy resin is 60 mass % or less. From the results in Table 1, it is determined that the coil components according to Examples 1 to 11, which make it possible to suppress the generation of cracks caused by the difference in linear expansion coefficient between the core and the exterior resin, and cracks caused by embrittlement of the exterior resin, have succeeded in suppressing the generation of cracks in the exterior resin due to a heat cycle from −40 to 125° C.

Comparative Examples 1 and 2 differ from Examples 1 and 5 in that the flange spacing is 2.0 mm, and from the results in Table 1, it is determined that the exterior resins according to Comparative Examples 1 and 2 are cracked. This is believed to be due to the fact that the flange spacing more than 1.0 mm increases the amount of the resin applied, and increases the stress generated by curing the resin, thus causing the exterior resin to fail to withstand the stress.

Comparative Examples 3 and 4 differ from Examples 1 and 2 in that the resin contained in the exterior resin is composed only of the epoxy resin, and from the results in Table 1, it is determined that the exterior resins according to Comparative Examples 3 and 4 are cracked by the heat cycle of −40 to 125° C. The resins contained in the exterior resins according to Comparative Examples 3 and 4 contain no phenoxy resin, or have no two-phase separated structure, thus entirely have a glass state at −40° C. to 125° C. Therefore, the exterior resins according to Comparative Examples 3 and 4 are believed to have been cracked by failure to withstand the stress of expansion and contraction during the heat cycle, because the rubber phase never absorb stress at high temperatures like the resins according to the examples.

Comparative Example 5 differs from Example 1 in that the phenoxy resin is 2.3 parts by weight which is larger than 2 parts by weight, and the proportion of the phenoxy resin to the total of the epoxy resin and phenoxy resin exceeds 60 mass %, and from the results in Table 1, it is determined that the exterior resin according to Comparative Example 5 is cracked by the heat cycle from −40 to 125° C. The phenoxy resin turns into a rubber state at a temperature in excess of the glass transition temperature around 100° C., and the rubber state has an increased coefficient of thermal expansion, as compared with the glass state. In addition, also in the glass state, the phenoxy resin is higher in coefficient of thermal expansion than the epoxy resin. Therefore, the resin according to Comparative Example 5, which is largely composed of the phenoxy resin, is believed to increase the expansion and contraction during the heat cycle to increase the stress generated in the exterior resin, thus resulting in cracking.

Comparative Examples 6 and 7 differ from Example 1 in that the proportion of the inorganic filler included in the exterior resin fails to fall within the range of 91 to 95 mass % with respect to the exterior resin, and from the results in Table 1, it is determined that the exterior resins according to Comparative Examples 6 and 7 are cracked by the heat cycle from −40 to 125° C. The reasons why the exterior resin according to Comparative Example 6 is cracked are believed to be the insufficiently reduced linear expansion coefficient of the exterior resin due to the low filling percentage of the inorganic filler, and the increased influence of the expansion and contraction of the resin. In addition, the reason why the exterior resin according to Comparative Example 7 is cracked is believed to be because the excessively high filling percentage of the inorganic filler caused embrittlement of the exterior resin to such an extent that the resin failed to withstand the stress of expansion and contraction due to the heat cycle.

Furthermore, as for the cores cracked by the heat cycle, Examples 1 to 4 differ from Examples 5 to 11 as to whether the proportion of the phenoxy resin to the exterior resin is 1 to 2 mass % or not, and from the results in Table 1, it is determined that the cores are cracked in Examples 1 to 4, whereas the cores are not cracked in Examples 5 to 11. This is believed to be because in Examples 5 to 11, the proportion of the phenoxy resin to the exterior resin from 1 to 2 mass % has reduced the storage elastic modulus of the exterior resin at 125° C. to 7.6 GPa or less, and caused the loss tangent tan δ at 100° C. to fall within the range of 0.06 to 0.1, thus succeeding in absorbing stress between the core and the exterior resin due to mounting substrate warpage caused during a heat cycle, while Examples 1 to 4 have failed to absorb stress due to mounting substrate warpage during a heat cycle, with the proportion of the phenoxy resin to the exterior resin outside 1 to 2 mass %, and the high storage elastic modulus of the exterior resin at 125° C.

In this regard, the compositions of the coil components according to the examples, in which the proportion of the phenoxy resin to the total of the epoxy resin and phenoxy resin is adjusted to 40 to 60 mass %, can provide more than one glass temperature, provide a phase-separated structure, and achieve the loss tangent tan δ at 100° C. within the range of 0.06 to 0.1.

In addition, the cores are cracked in both Comparative Examples 1 and 2, and this is believed to be because high stress due to warpage of the mounting substrates with the large-size cores was not able to be absorbed. Moreover, in Comparative Examples 3 and 4, the cores are not cracked even though the storage elastic moduli of the exterior resins at 125° C. are not 7.6 GPa or less, and this is believed to be because stress due to warpage of the mounting substrates was absorbed by the exterior resins cracked.

In the examples described above, the exterior resin includes the phenoxy resin and epoxy resin which differ in glass transition temperature, so as to constitute a two-phase separated structure. When these resins are dissolved and mixed, methyl ethyl ketone (MEK) is mainly used, because the phenoxy resin is poorly soluble.

In this regard, the MEK for dissolving the phenoxy resin also dissolves the curing accelerator mixed with the phenoxy resin. For this reason, the exterior resin obtained by the mixing as a coating material was, when the resin is applied and subjected to curing after a lapse of days, slowly cured to increase the viscosity of the coating material, and affect workability, component characteristics, etc. Therefore, in order to resolve this problem, a coil component according to the present invention was obtained in accordance with the following procedure according to Example 12.

Example 12

Mixed were: 662.7 g of ferrite (D50=0.6 μm) and 139.5 g of spherical silica (D50=8.0 μm) as an inorganic filler; 17.8 g of cresol novolac-type epoxy resin (epoxy equivalent 218) as an epoxy resin; 8.7 g of phenolic resin as a curing agent; 6.5 g of phenoxy resin (MW=50,000); 145.1 g of dipropylene methyl ether acetate as a solvent; 6.4 g of a dispersant; and 3.0 g of a coupling agent, for obtaining a main agent. Further, 0.3 g of an imidazole-based curing accelerator and 10.0 g of dipropylene methyl ether acetate were mixed to prepare an accessory agent. Both the main agent and the accessory agent were mixed before curing, the same solvent was added to the mixed agents to attenuate the viscosity to approximately 1 Pa·s, and the agents were applied to a copper wire-wound drum-shaped ferrite core with flange spacing of 0.85 mm with the use of a dispenser (inside nozzle diameter: 250 μm), and subjected to drying at 80° C., and curing at 150° C. to obtain a coil component.

On the main agent and accessory agent used for the coil component according to Example 12, the change in viscosity was measured with respect to the number of days from leaving the agents under environments at 40° C. and 25° C. after the preparation of the agents. In addition, for comparison, the viscosity change with the lapse of days was also measured in the same manner, on the exterior resin according to Example 1, which was prepared without division into the main agent and the accessory agent, unlike Example 12. For the viscosity measurement, an E-type viscometer was used. The number of revolutions of the E-type viscometer was adjusted to 10 rpm for the measurement. Tables 2 and 3 respectively show the viscosity changes with the lapse of days on the exterior resin according to Example 1 and the main agent and accessory agent according to Example 12, which were left under the temperatures of 40° C. and 25° C. The ratios to the viscosity immediately after the preparation are shown in the parentheses below the measurement values of the viscosity of the main agent according to Example 1.

TABLE 2

(Viscosity Measurement at 40° C.)

| | | The Number of Days from Preparation | | | | |
|---|---|---|---|---|---|---|
| | | Immediately after preparation | After 3 days | After 7 days | After 11 days | After 14 days |
| Example 1 | Viscosity of Exterior Resin (Pa · s) | 30 | 39 | 48 | 56 | 80 |
| | (Ratio to Initial Viscosity) | | (1.29) | (1.56) | (1.83) | (2.63) |
| Example 12 | Viscosity of Main Agent (Pa · s) | 31 | 32 | 32 | 32 | 32 |
| | Viscosity of Accessory Agent (Pa · s) | Less than 1 | Less than 1 | Less than 1 | Less than 1 | Less than 2 |

TABLE 3

(Viscosity Measurement at 25° C.)

| | | The Number of Days from Preparation | | | | | |
|---|---|---|---|---|---|---|---|
| | | Immediately after preparation | After 14 days | After 32 days | After 45 days | After 63 days | After 95 days |
| Example 1 | Viscosity of Exterior Resin (Pa · s) | 30 | 34 | 39 | 40 | 49 | 60 |
| | (Ratio to Initial Viscosity) | | (1.12) | (1.26) | (1.32) | (1.61) | (1.98) |
| Example 12 | Viscosity of Main Agent (Pa · s) | 30 | 30 | 31 | 31 | 31 | 31 |
| | Viscosity of Accessory Agent (Pa · s) | Less than 1 | Less than 1 | Less than 1 | Less than 1 | Less than 1 | Less than 2 |

From Table 2, the viscosity of the exterior resin according to Example 1 was gradually increased with the lapse of days, and the exterior resin left at 40° C. and the exterior resin left at 25° C. were 1.2 times or more thickened relative to the initial viscosity as a viscosity measurement value immediately after the preparation, respectively after 3 days from the preparation and after 32 days from the preparation. On the other hand, there is almost no change with the lapse of days in the viscosity of the main agent according to Example 12. Furthermore, the accessory agent according to Example 12 is substantially low in viscosity with respect to the main agent, and the ratio of the viscosity to the initial viscosity is thus not an issue.

As just described, in Example 12, the main agent and the accessory agent are hardly cured progressively with the lapse of days, because the MEK for dissolving the phenoxy resin dissolves the curing accelerator only after mixing the main agent and the accessory agent. The exterior resin including the main agent and the accessory agent can be obtained in a way that the main agent and the accessory agent are mixed immediately before applying, as a coating material, applied to the core, and subjected to curing. Accordingly, influences on workability, component characteristics, etc. can be suppressed without going through gradual curing by the dissolution of the curing accelerator as in Example 1, or increasing the viscosity of the coating material.

DESCRIPTION OF REFERENCE SYMBOLS

1 core
1*a* upper flange
1*b* lower flange
2 winding
3, 4 external electrode
5 exterior resin
100 coil component

The invention claimed is:

1. A coil component comprising:

a drum-shaped core having an upper flange and a lower flange;

a winding wound around the core; and an exterior resin between the upper flange and the lower flange, wherein the exterior resin comprises:

an inorganic filler at 91 to 95 mass % with respect to the exterior resin; and a resin having more than one glass transition temperature and having a phase-separated structure, and a flange spacing distance between the upper flange and the lower flange is 1.0 mm or less.

2. The coil component according to claim 1, wherein the drum-shaped core is a magnetic body.

3. The coil component according to claim 1, further comprising external electrodes on a surface of the lower flange, the external electrodes being electrically connected to the winding.

4. The coil component according to claim 1, wherein the inorganic filler comprises one or more types of fillers.

5. The coil component according to claim 4, wherein one of the inorganic fillers is a spherical silica powder or a Ni—Zn ferrite powder.

6. The coil component according to claim 1, wherein the exterior resin contains a ferrite powder.

7. The coil component according to claim 6, wherein a proportion of the ferrite powder to the exterior resin is 50 to 91 mass %.

8. The coil component according to claim 1, wherein a ratio of a loss elastic modulus to a storage elastic modulus at 100° C. is 0.06 to 0.1 in the exterior resin.

9. The coil component according to claim 1, wherein the exterior resin has a storage elastic modulus of 7.6 GPa or less at 125° C.

10. The coil component according to claim 1, wherein the resin includes an epoxy resin and a phenoxy resin.

11. The coil component according to claim 10, wherein a proportion of the phenoxy resin to a total of the epoxy resin and the phenoxy resin is 40 to 60 mass %.

12. The coil component according to claim 10, wherein the epoxy resin is a cresol novolac epoxy resin.

13. The coil component according to claim 10, wherein a proportion of the phenoxy resin to the exterior resin is 1 to 2 mass %.

14. The coil component according to claim 10, wherein the epoxy resin is a cresol novolac epoxy resin.

15. The coil component according to claim 1, wherein the flange spacing is 0.3 mm to 1.0 mm.

16. The coil component according to claim 1, wherein the exterior resin includes:

a main agent containing the resin having more than one glass transition temperature and the phase-separated structure, and containing no curing accelerator; and an accessory agent containing no resin, and containing the curing accelerator.

* * * * *